US006246399B1

(12) United States Patent
Yamane et al.

(10) Patent No.: US 6,246,399 B1
(45) **Date of Patent: *Jun. 12, 2001**

(54) ACTIVE MATRIX LIQUID CRYSTAL DISPLAY

(75) Inventors: Yasukuni Yamane, Nara; Jun Koyama; Hidehiko Chimura, both of Kanagawa, all of (JP)

(73) Assignee: Semiconductor Energy Laboratory Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/617,415

(22) Filed: Mar. 18, 1996

(30) Foreign Application Priority Data

Mar. 17, 1995 (JP) ..... 7-086315

(51) Int. Cl.[7] ..... G09G 3/18

(52) U.S. Cl. ..... 345/211; 345/103; 345/98; 345/1; 713/321

(58) Field of Search ..... 345/100, 98, 210, 345/87–103, 211, 1–3; 364/707; 713/320, 321

(56) References Cited

U.S. PATENT DOCUMENTS

| | | | | |
|---|---|---|---|---|
| 4,679,043 | * | 7/1987 | Morokawa | 340/784 |
| 4,795,239 | * | 1/1989 | Yamashita et al. | 345/87 |
| 4,816,816 | * | 3/1989 | Usui | 340/784 |
| 4,963,860 | | 10/1990 | Stewart | 345/206 |
| 5,051,739 | | 9/1991 | Hayashida et al. | 345/98 |
| 5,136,282 | * | 8/1992 | Inaba et al. | 345/103 |
| 5,218,352 | * | 6/1993 | Endoh et al. | 340/811 |
| 5,250,931 | | 10/1993 | Misawa et al. | 345/98 |
| 5,376,944 | * | 12/1994 | Mogi et al. | 345/103 |
| 5,394,166 | * | 2/1995 | Shinada | 345/98 |
| 5,512,915 | * | 4/1996 | Leroux | 345/103 |
| 5,555,001 | | 9/1996 | Lee et al. | 345/93 |
| 5,563,624 | * | 10/1996 | Imamura | 345/100 |
| 5,574,475 | | 11/1996 | Callahan, Jr. et al. | 345/100 |
| 5,585,816 | | 12/1996 | Scheffer et al. | 345/100 |
| 5,598,178 | * | 1/1997 | Kawamori | 345/103 |
| 5,598,180 | * | 1/1997 | Suzuki et al. | 345/100 |
| 5,629,715 | * | 5/1997 | Zenda | 345/211 |
| 5,703,616 | | 12/1997 | Kawasugi | 345/98 |
| 5,798,741 | * | 8/1998 | Kajihara | 345/94 |
| 5,801,674 | * | 9/1998 | Shiniju | 345/98 |

FOREIGN PATENT DOCUMENTS

| | | | |
|---|---|---|---|
| 3-248122A | * | 11/1991 | (JP) . |
| 4-186281 | | 7/1992 | (JP) . |

* cited by examiner

*Primary Examiner*—Lun-Yi Lao
(74) *Attorney, Agent, or Firm*—Fish & Richardson PC

(57) ABSTRACT

An active matrix liquid crystal display consuming only a small amount of electric power. The liquid crystal display has two driver circuits which drive two sets of signal lines, respectively, One set of signal lines creates the upper half of a frame of image displayed on the viewing screen, while the other set of signal lines creates the lower half of the image. An image signal for creating the frame of image is supplied to the two driver circuits alternately so that when one of the driver circuits is operating, the other is halted or put on standby.

16 Claims, 12 Drawing Sheets

ACTIVE MATRIX LIQUID CRYSTAL DISPLAY

BACKGROUND OF THE INVENTION

1. Field of the Invention

The present invention relates to an active matrix liquid crystal display and, more particularly, to an active matrix liquid crystal display consuming less electric power than a conventional display.

2. Description of the Related Art

In an active matrix liquid crystal display, a pixel is disposed at each intersection in a matrix construction. Every pixel is equipped with a switching device. Information about the pixels is represented by turning on and off the switching devices. A liquid crystal is used as a display medium in such a display device. In the present invention, thin-film transistors (TFTs) each having three terminals, i.e., gate, source, and drain, are used as switching devices.

In the present specification, a row of the matrix construction means scanning lines (gate lines) which extend parallel to the row and are connected with the gate electrodes of the TFTs in the row. A column of the matrix construction means signal lines (source lines) which run parallel to the column and are connected with the source (or drain) electrodes of the TFTs in the column. A circuit for driving the scanning lines is referred to as a scanning line driver circuit. A circuit for driving the signal lines is referred to as a signal line driver circuit.

FIG. 2 shows one conventional active matrix liquid crystal display. A signal line driver circuit 21 is mounted at the top and a scanning line driver circuit 22 is mounted on the left side to drive signal lines 23 and scanning lines 24, respectively. The scanning line driver circuit 22 and the signal line driver circuit 21 receive signals such as clock pulses from a signal-generating circuit such as a clock generator.

A scanning line driver circuit 22 using shift registers 35 as shown in FIG. 3(*a*) is normally used. Whenever a clock pulse (CL1,CL2) is entered, the output pulse is shifted by one position. The output pulse is fed to one scanning line 32 via a NAND gate 33 and a buffer circuit 34. In this way, the scanning lines 32 are successively driven. FIG. 3(*b*) shows timing charts of the scanning line driver circuit 22.

In the case of a video graphics array (VGA), each scanning line is scanned in about 31 $\mu$s.

One example of the signal line driver circuit 21 is shown in FIG. 4. Signal line driver circuits 21 normally use shift registers 41 in the same way as scanning line driver circuits 22. However, the signal line driver circuit 21 does not directly drive signal lines 44, unlike a scanning line driver circuit 22. The output signal from a shift register 41 drives a sampling analog switch 43 via a buffer circuit 42. The analog video signal 45 is sampled and fed to the signal lines 44.

In the case of VGA, the ideal sampling time is about 40 nsec. Where the signal line driver circuit 21 is composed of TFTs, the sampling time is set to 320 nsec or 640 nsec, taking account of the performance of the TFTs. In this case, 4-phase or 8-phase clock pulses which are shifted from each other in phase by 40 nsec are used.

Another conventional active matrix liquid crystal display is described in Japanese Patent Laid-Open No. 186281/1992 and shown in FIG. 5. In this construction, signal lines 50 are divided into plural groups. The signal lines 50 are driven from both ends of the display device. Since the load capacitance and load resistance for signals are halved, it is easy to drive the signal lines 50.

Examples of commercial products using active matrix liquid crystal displays include notebook computers and portable intelligent terminals. These commercial products are required to be driven by batteries. However, the service time of the existing active matrix liquid crystal display is limited by the amount of electric power consumed by the display. Accordingly, it is important to reduce the electric power consumed by the active matrix liquid crystal display in obtaining a longer service time.

The current worldwide trend is toward saving of resources. Active matrix liquid crystal displays which are considered to be promising next-generation display devices must accomplish lower power consumption.

One conceivable method of reducing the electric power consumption is to reduce the applied voltage or the operating frequency. However, this method deteriorates the performance. Therefore, a method of reducing the electric power consumption while maintaining the performance has been sought for.

In the conventional method described already in connection with FIG. 5, the signal line capacitance is halved. Let P2 be the electric power consumed when signal lines are driven. Let P1 be the electric power consumed when signal lines are driven by the construction described previously in connection with FIG. 2. The following relations hold:

$$P2=C1/2\times V2\times f$$

$$P1/2$$

where C1 is the capacitance of the signal lines, V is the amplitude of the signal, and f is the operating frequency.

In this way, the electric power consumed by the configuration shown in FIG. 5 can be halved compared with the electric power consumed by the configuration shown in FIG. 2. However, two driver circuits are required to be disposed at opposite ends, respectively, of the display device. Therefore, the total electric power consumed by the driver circuits is doubled compared with the electric power consumed by the driver circuit shown in FIG. 2. Hence, the electric power consumed is increased accordingly. With respect to the driver circuits, the load is halved. However, each driver circuit must have the same number of stages of shift registers as the stages of shift registers of the driver circuit in the configuration shown in FIG. 2. Therefore, the electric power for driving the shift registers is doubled. Furthermore, the electric power needed to drive the common clock terminal for applying clock pulses to the shift registers is doubled. In addition, the electric power required to drive the video signal input terminal is doubled. These electric powers are comparable to or greater than the electric power for driving the signal lines.

The method described in the above-cited Japanese Patent Laid-Open No. 186281/1992 was originally developed to drive a large area display. Therefore, this method is a disadvantage in reducing electric power consumption.

SUMMARY OF THE INVENTION

It is an object of the present invention to provide an active matrix liquid crystal display having signal lines which create a frame of image on a viewing screen and are divided into upper and lower groups to reduce the electric power consumed by the load capacitance of the signal lines, in the same way as in the conventional configuration shown in FIG. 5.

We have noticed that when the viewing screen is being scanned successively from top to below, e.g., when the upper half of the screen is being scanned, the driver circuit for the lower half is not required to be driven. Accordingly, the invention provides a means for halting the driver circuit for the lower signal lines or putting this driver circuit on standby. Obviously, when the lower half of the display screen is being scanned, the driver circuit for the upper signal lines is halted or put on standby.

Other objects and features of the invention will appear in the course of the description thereof, which follows.

BRIEF DESCRIPTION OF THE DRAWINGS

FIG. 3(*b*) is a time chart explaining the operation of the circuit shown in FIG. 3(*a*);

FIG. 6(*b*) is a time chart for explaining the operation of the circuit shown in FIG. 6(*a*);

DETAILED DESCRIPTION OF THE PREFERRED EMBODIMENTS

Figure 1:
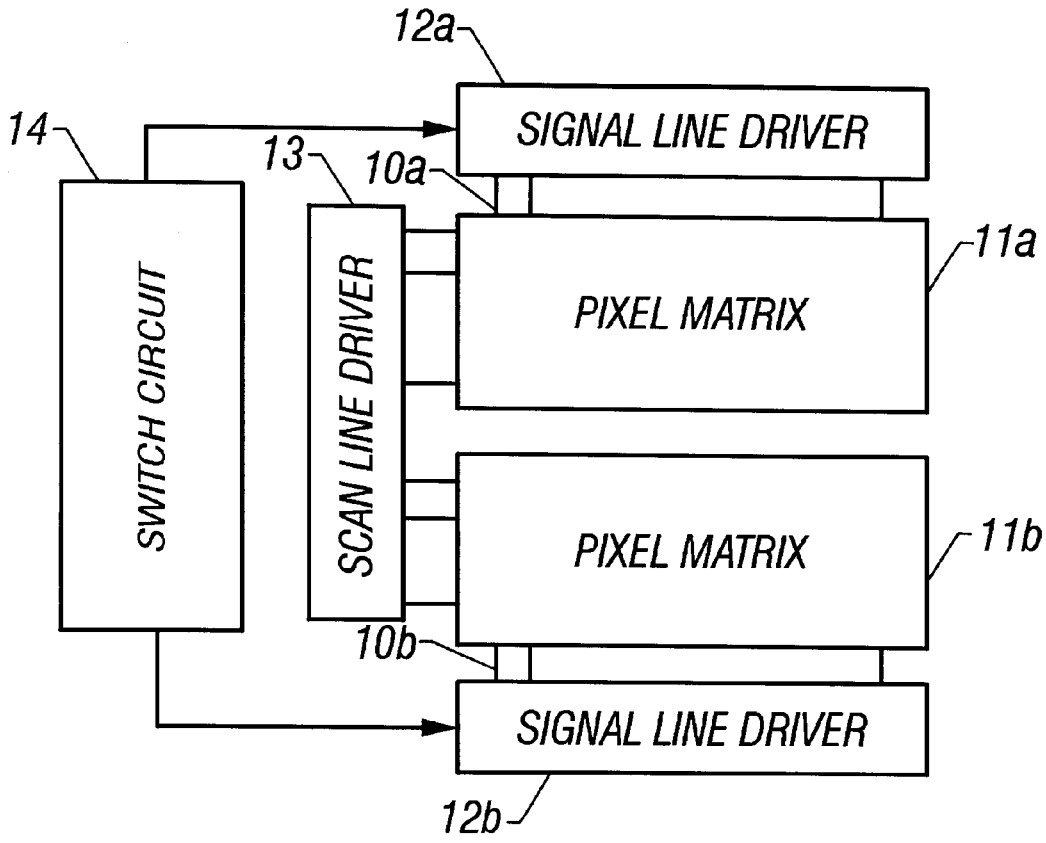
FIG. 1 is a block diagram of an active matrix liquid crystal display according to the invention.
Figure 2:
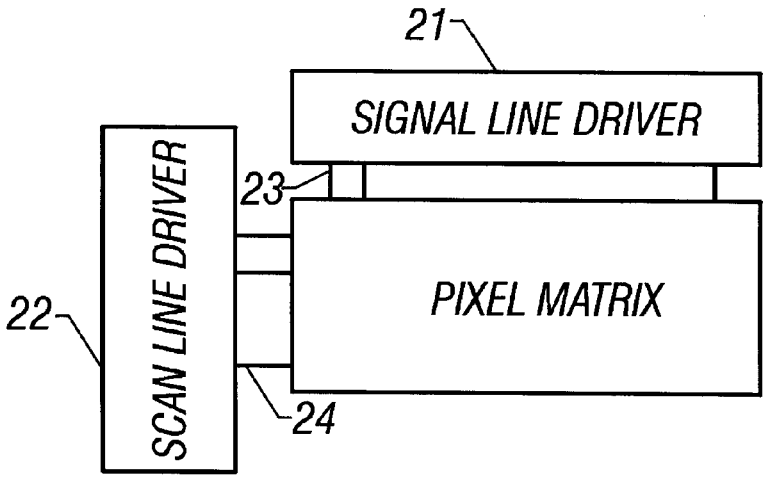
FIG. 2 is a block diagram of a known active matrix liquid crystal display.
Figure 3A:
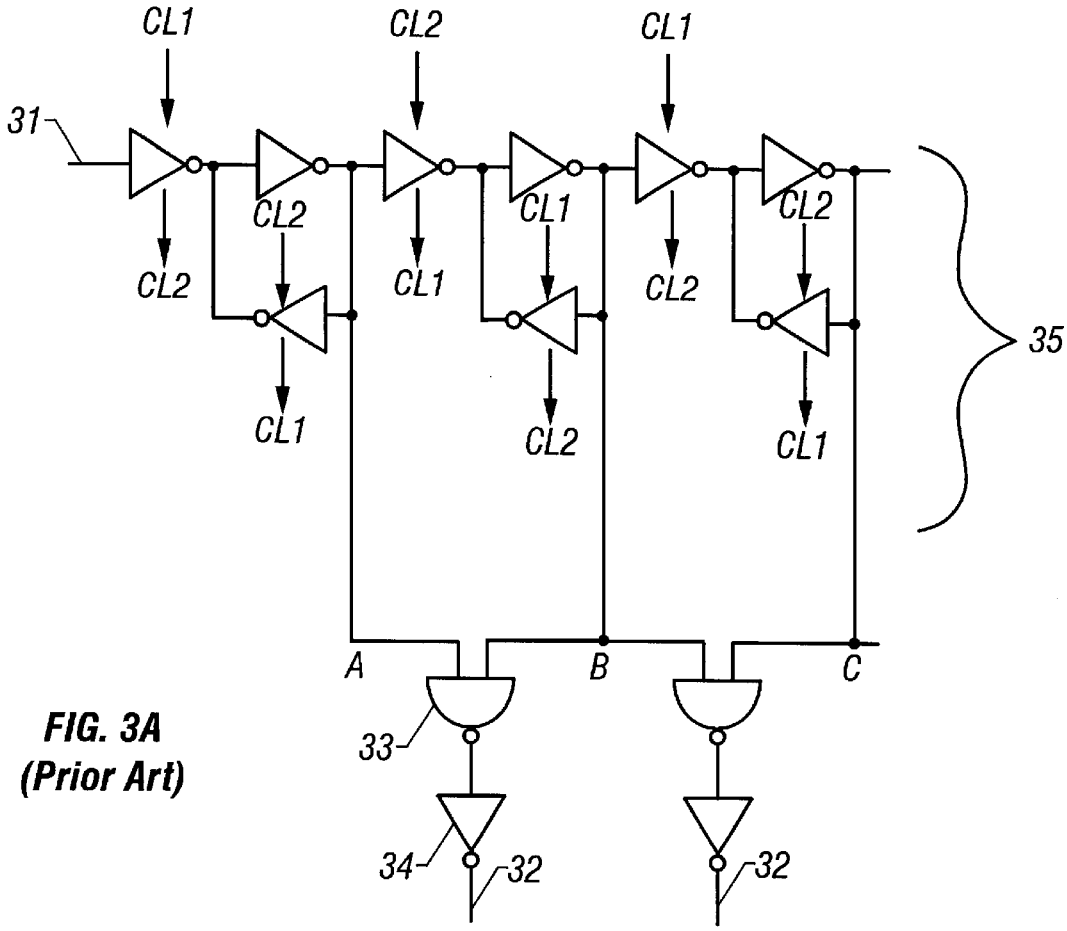
FIG. 3A (Prior Art)
FIG. 3(*a*) is a diagram of a general scanning line driver circuit.
Figure 3B:
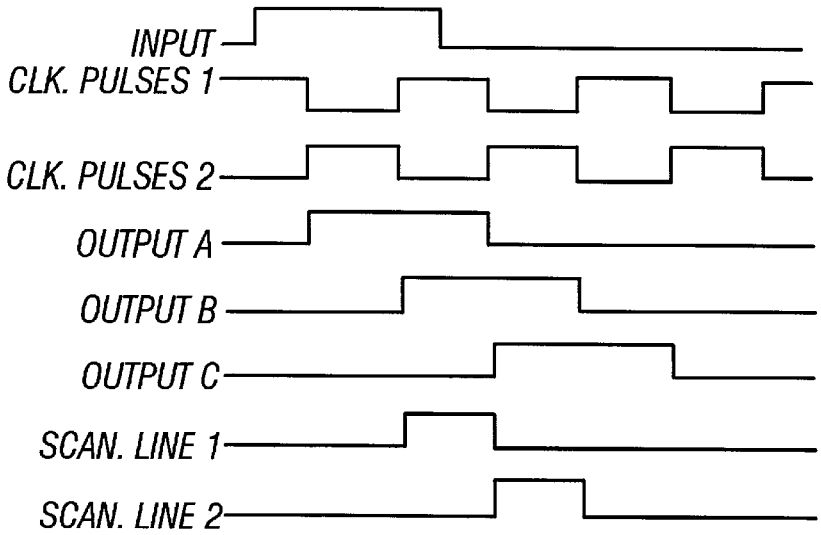
FIG. 3B (Prior Art)
Figure 4:
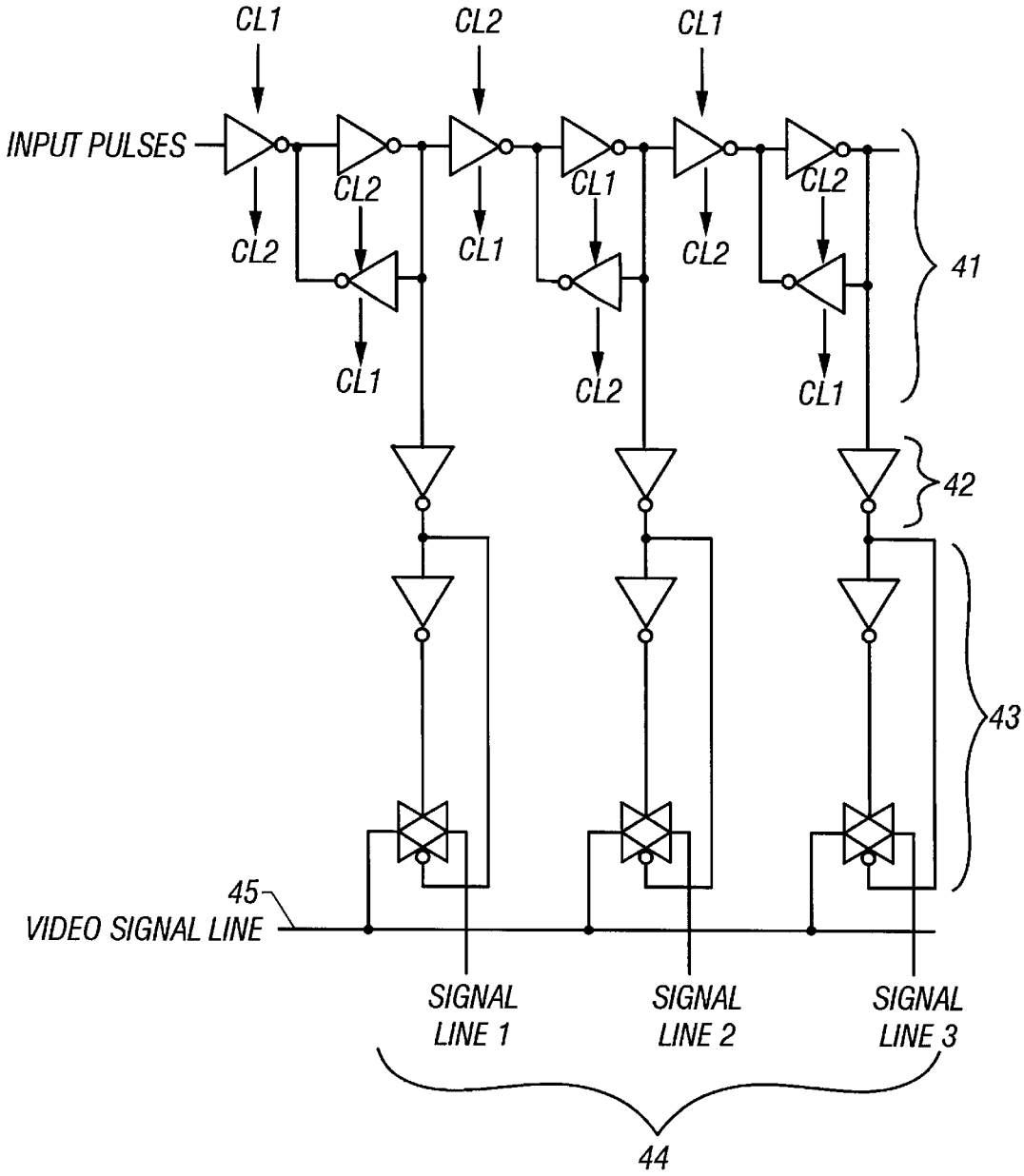
FIG.4 (Prior Art)
FIG. 4 is a diagram of a general signal line driver circuit.
Figure 5:
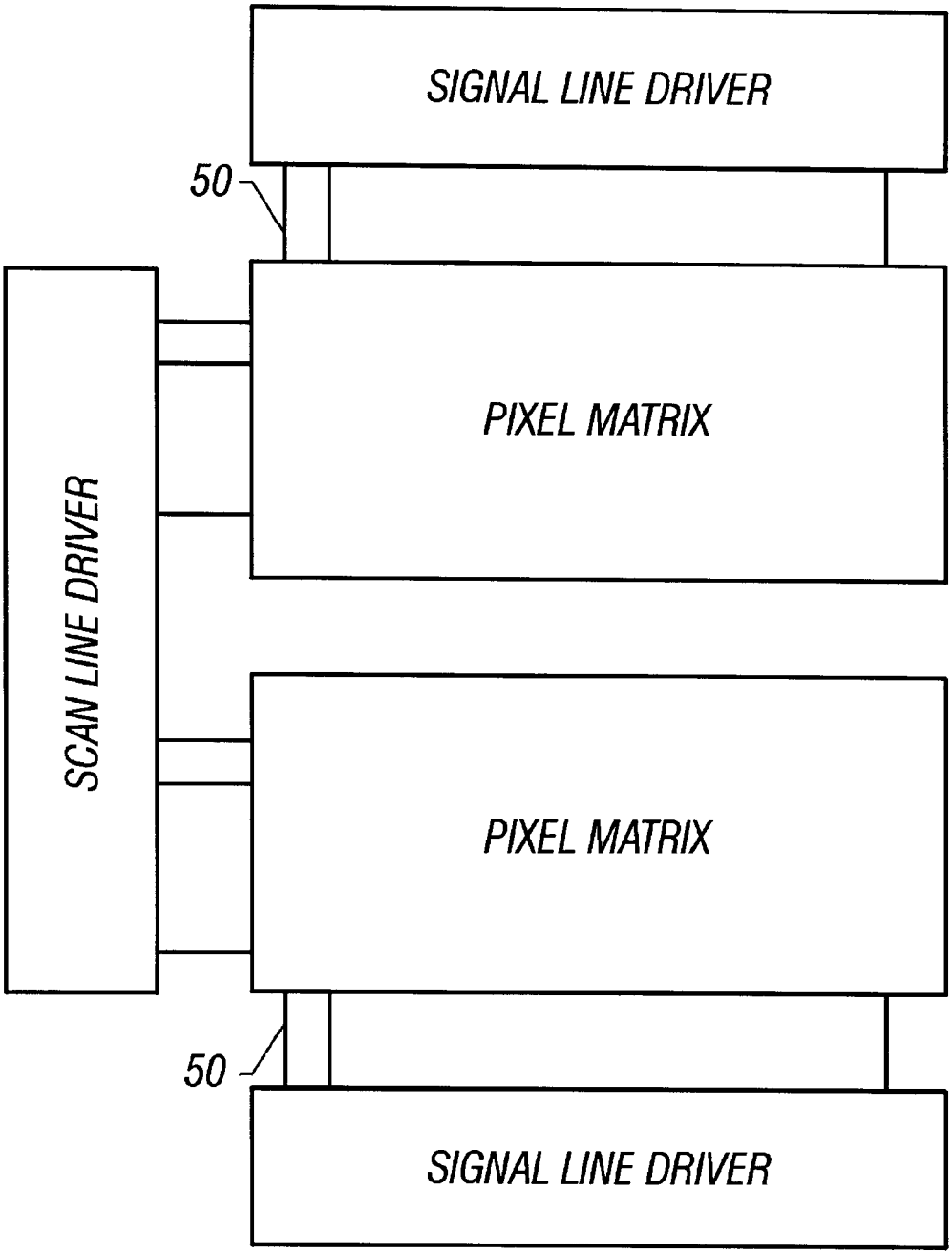
FIG. 5 (Prior Art)
FIG. 5 is a block diagram of another known active matrix liquid crystal display.

Referring to FIG. 1, there is shown an active matrix liquid crystal display embodying the concept of the present invention. This liquid crystal display has signal lines 10 which drive an upper pixel matrix construction 11*a* and a lower pixel matrix construction 11*b* on opposite sides of the center line of the frame of image displayed on the viewing screen of the liquid crystal display. The signal lines 10*a* for the upper pixel matrix 11*a* are driven by an upper signal line driver circuit 12*a*. The signal lines 10*b* for the lower pixel matrix 11*b* are driven by a lower signal line driver circuit 12*b*. The liquid crystal display further includes a scanning line driver circuit 13 and a state-switching circuit 14 for halting the two signal line driver circuits 12*a*,12*b* alternately.

Figure 6A:
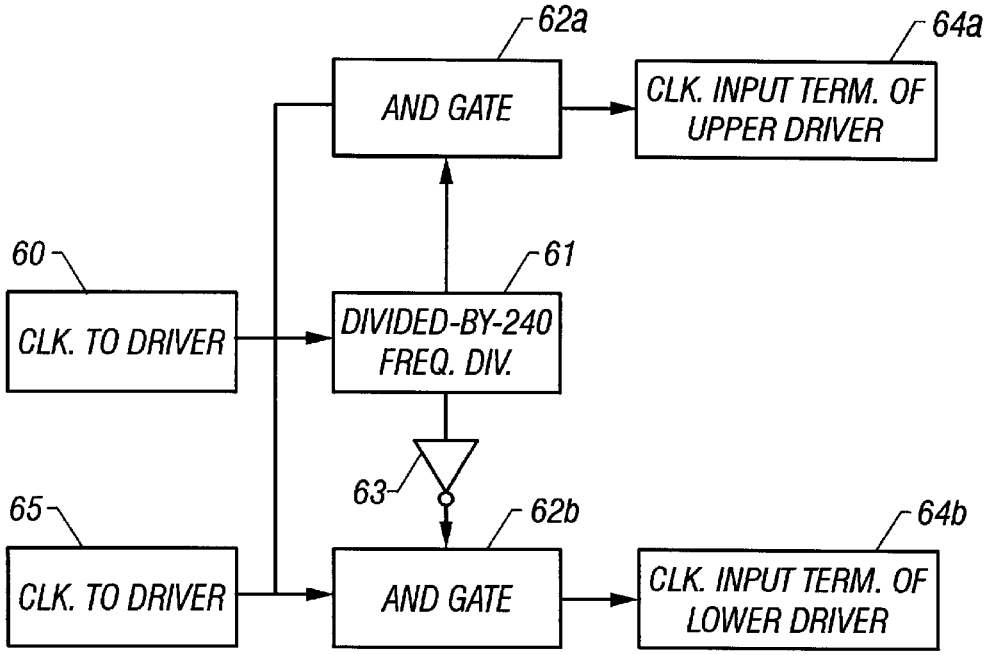
FIG. 6(*a*) is a circuit diagram of a state-switching circuit for alternately halting two signal line driver circuits according to the invention.
Figure 6B:
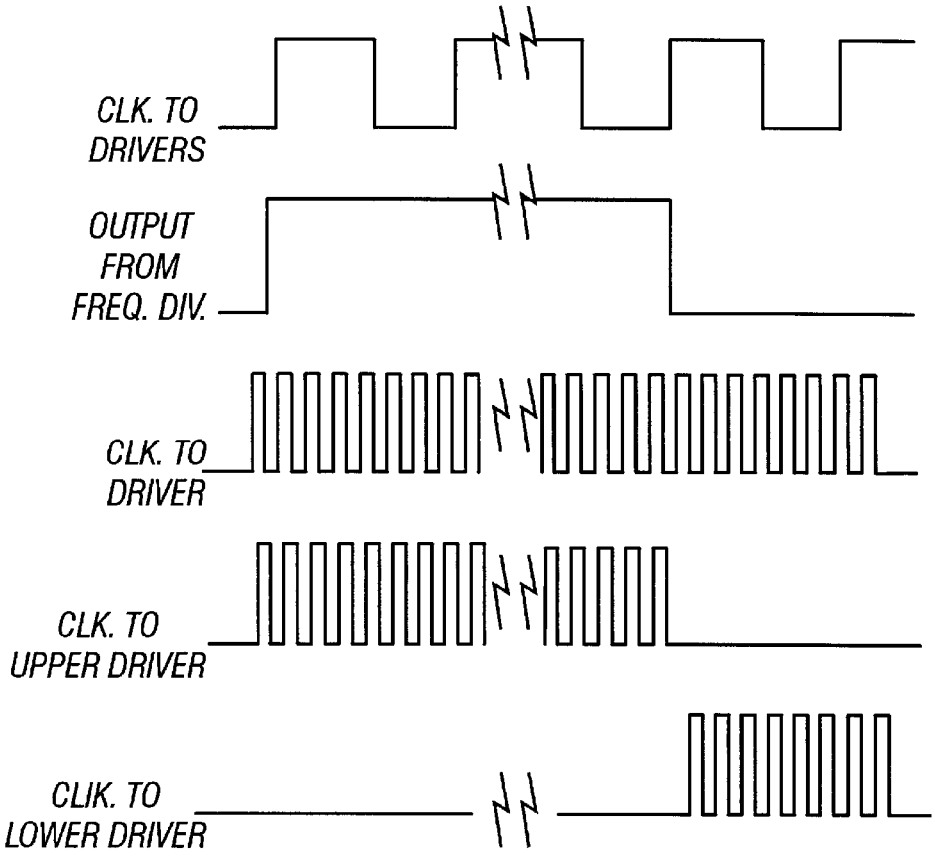

FIG. 6 shows an example of the state-switching circuit according to the invention. In this example, clock pulses 60 to be applied to the scanning line driver circuits are first supplied to the state-switching circuit. This state-switching circuit comprises a frequency division circuit 61, an upper AND gate 62*a* connected to the output of the frequency division circuit 61, an inverter 63 connected to the output of the frequency division circuit 61, and a lower AND gate 62*b* connected to the inverter 63. In the case of a VGA (video graphics array), the frequency division circuit 61 is a divided-by-240 frequency division circuit. The output of the upper AND gate 62*a* is connected with the clock input terminal 64*a* of the upper signal line driver circuit 12*a*. Similarly, the output of the lower AND gate 62*b* is connected with the clock input terminal 64*b* of the lower signal line driver circuit 12*b*. This switching circuit 14 controls the clock pulses 65 supplied to the signal line driver circuits 12.

As shown in timing charts of in FIG. 6(*b*), when the upper half of the image is being scanned, the clock pulses 65 are prevented from entering the lower signal line driver circuit 12*b*. When the lower half of the frame of image is being scanned, the clock pulses 65 are prevented from entering the upper signal line driver circuit 12*a*. By the addition of this switching circuit 14, unwanted consumption of electric power by one signal line driver circuit 12 can be eliminated.

Figure 7:
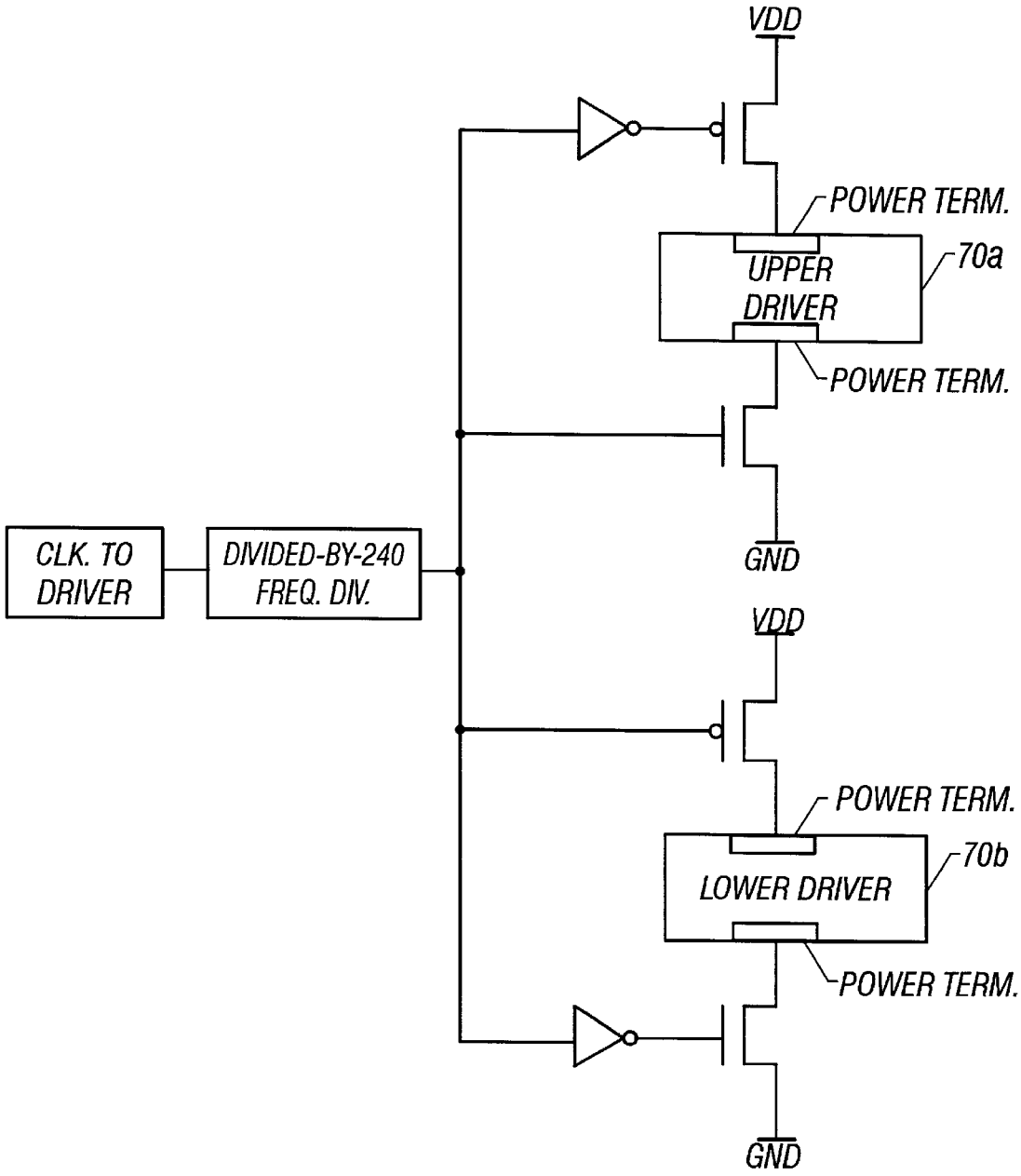
FIG. 7 is a circuit diagram of another state-switching circuit for alternately deactivating two signal line driver circuits according to the invention.

FIG. 7 shows another example of the state-switching circuit 14 according to the invention. Electric power to be supplied to two signal line driver circuits 70*a*, 70*b* is switched between scanning of the upper half of the frame of image on the viewing screen and the scanning of the lower half. In the same way as the method described already in connection with FIG. 6, a signal for switching between the upper half of the frame of image and the lower half is used to deactivate shift registers alternately.

Figure 8:
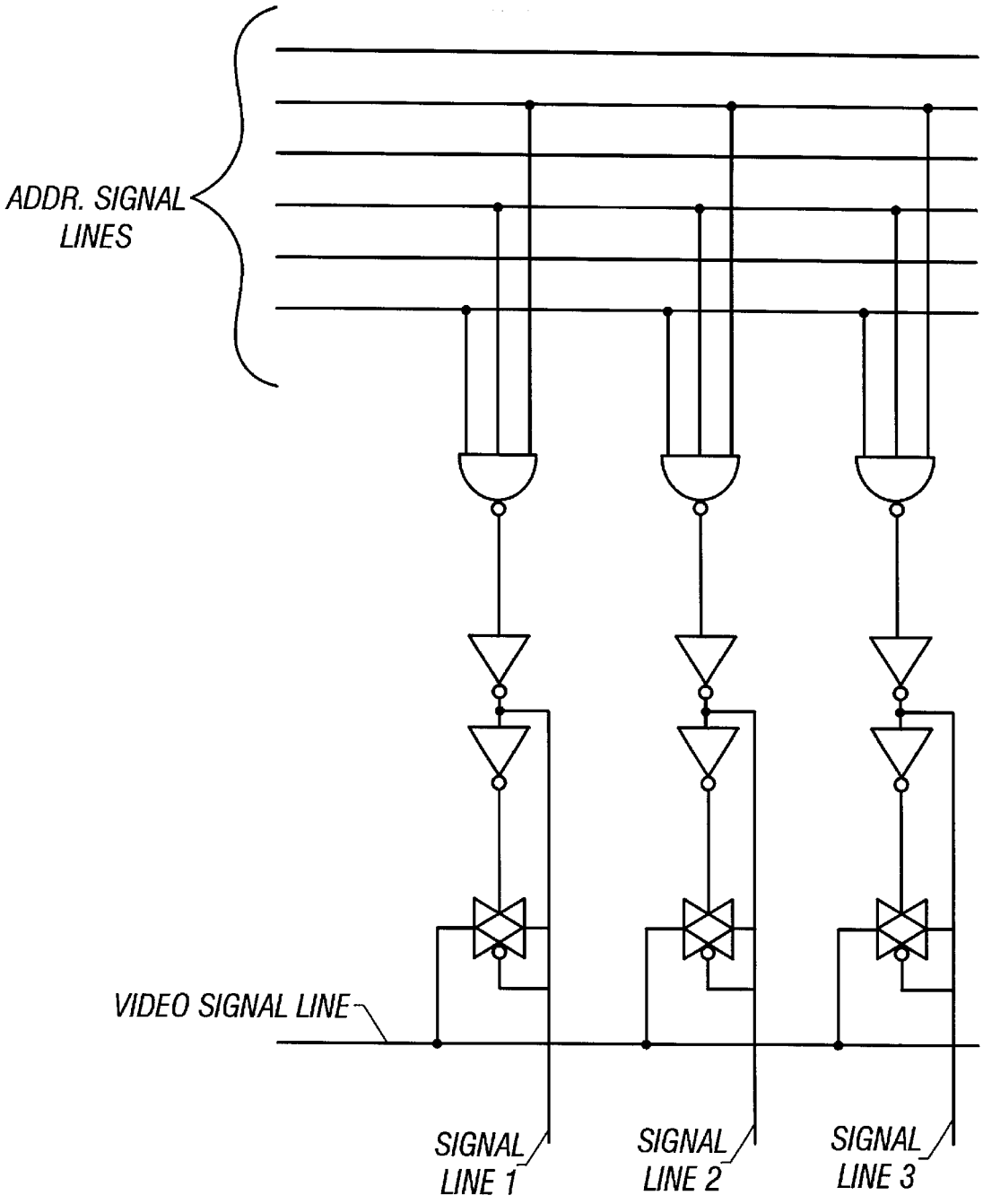
FIG. 8 is a circuit diagram of signal line driver circuits using decoder circuits according to the invention.

FIG. 8 shows an example in which decoder circuits are used in signal line driver circuits.

Figure 9:
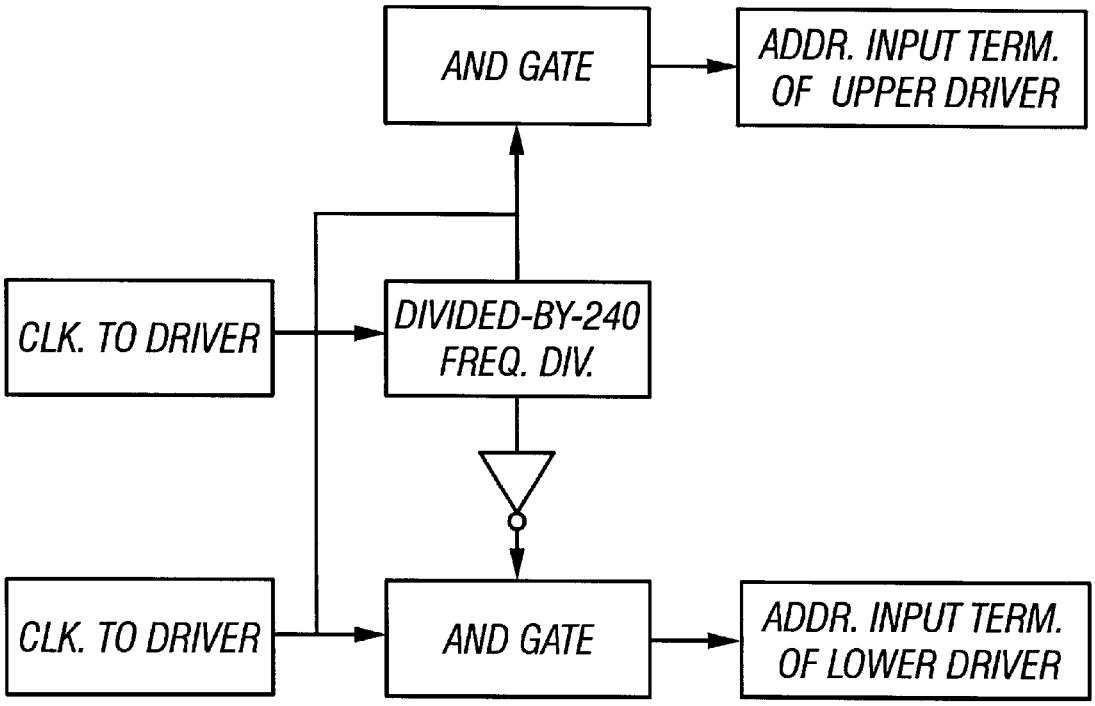
FIG. 9 is a circuit diagram of a further state-switching circuit for stopping supply of an address signal to two signal line driver circuits alternately according to the invention.
Figure 10A:
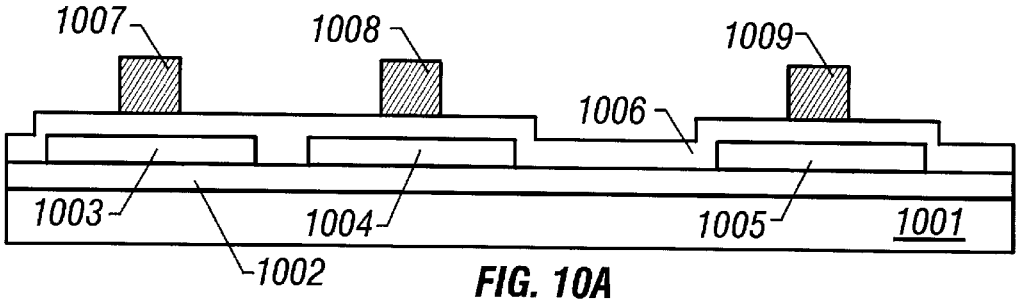
FIGS. 10(A)–10(D) are cross-sectional views of an active matrix liquid crystal display, illustrating some low-tempera ture polysilicon process steps for fabricating the display.
Figure 10B:
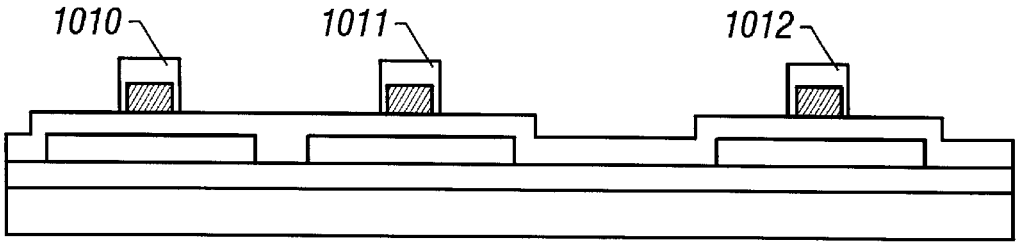
Figure 10C:
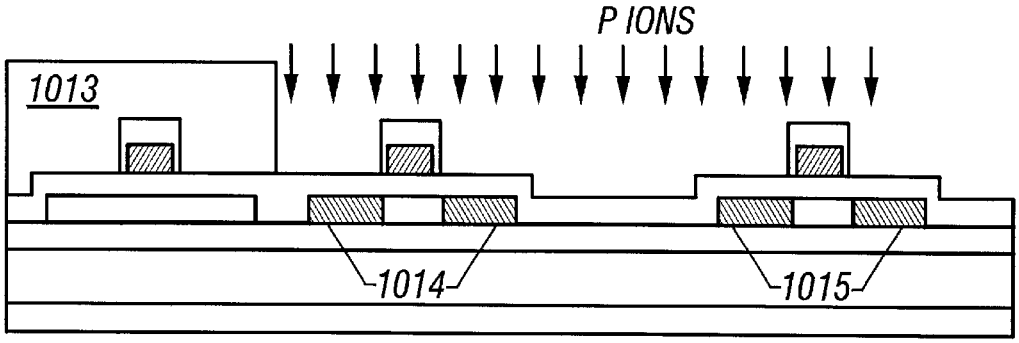
Figure 10D:
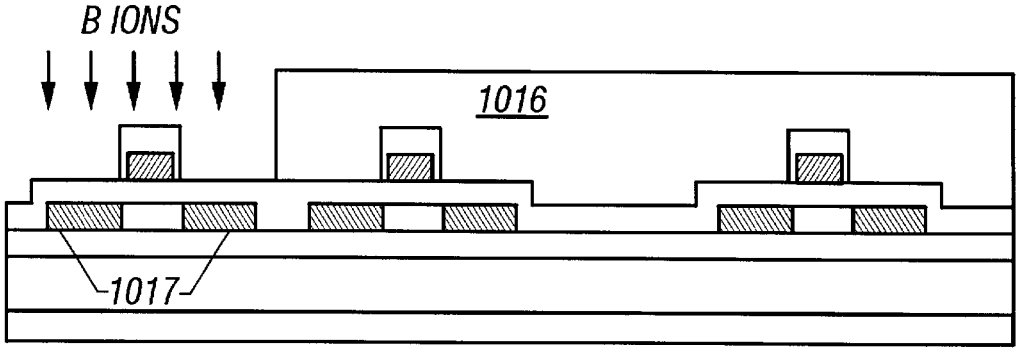

FIG. 9 shows a further example of the state-switching circuit 14 according to the invention. The operation of the signal line driver circuit which is not presently used can be stopped by cutting off supply of an address signal to the decoder circuit.

A method of fabricating TFT substrates of a liquid crystal display, using an active matrix circuit according to the invention, is described below.

FIGS. 10(A)–10(D) and 11(A)–11(B) illustrate low-temperature polysilicon process steps for fabricating a monolithic active matrix circuit of the present example. The process sequence for fabricating TFTs forming a peripheral logic circuit is shown on the left sides of FIGS. 10(A)–10(D) The process sequence for fabricating the active matrix circuit is shown on the right sides. First, a silicon oxide film 1002 is formed as a buffer oxide film 1002 on a glass substrate 1001 to a thickness of 1000 to 3000 Å. This silicon oxide film may be formed in an oxygen ambient by sputtering or plasma CVD.

Then, an amorphous silicon film is formed to a thickness of 300 to 1500 Å, preferably 500 to 1000 Å, by plasma CVD or LPCVD. The amorphous film is thermally annealed at a temperature higher than 500° C., preferably 500–600° C., to crystallize the amorphous silicon film or to enhance the crystallinity. After the crystallization, the crystallinity may be further enhanced by carrying out photo-annealing making use of laser light. Furthermore, during the crystallization making use of thermal annealing, an element (or, a catalytic element) such as nickel for promoting crystallization of silicon may be added, as described in Japanese Patent Laid-Open Nos. 244103/1994 and 244104/1994.

Then, the silicon film is etched to form islands of an active layer 1003 for P-channel TFTs forming a driver circuit, islands of an active layer 1004 for N-channel TFTs, and islands of an active layer 1005 for pixel TFTs forming a matrix circuit. Furthermore, a gate-insulating film 1006 of silicon oxide is formed to a thickness of 500 to 2000 Å by sputtering in an oxygen ambient. The gate-insulating film may be formed by plasma CVD. Where the silicon oxide film is formed by plasma CVD, it is desired to use nitrogen monoxide ($N_2O$) as a gaseous raw material. Alternatively, oxygen ($O_2$) and monosilane ($SiH_4$) may be employed.

Subsequently, an aluminum layer having a thickness of 2000 to 6000 Å is formed by sputtering over the whole surface of the laminate. The aluminum may contain silicon, scandium, palladium, or other material to prevent generation of hillocks in later thermal processing steps. The gate-insulating film 1006 is etched to form gate electrodes 1007, 1008, and 1009 (FIG. 10(A)).

Thereafter, the aluminum layer is anodized to form aluminum oxide, 1010, 1011, and 1012, on the surface of the aluminum layer. These aluminum regions act as insulator (FIG. 10(B)).

Then, a photoresist mask 1013 which covers the active layer of the P-channel TFTs is formed. Phosphorus ions are introduced by ion doping while using phosphine as a dopant gas. The dose is $1\times10^{12}$ to $5\times10^{13}$ atoms/cm$^2$. As a result, heavily doped N-type regions, or source 1014 and drain 1015, are formed (FIG. 10(C)).

Thereafter, a photoresist mask 1016 for covering both active layer for the N-channel TFTs and active layer for the pixel TFTs is formed. Boron ions are introduced again by ion doping, using diborane ($B_2H_6$) as a dopant gas. The dose is $5\times10^{14}$ to $8\times10_{15}$ atoms/cm$^2$. As a result, P-type regions 1017 are formed. Because of the doping steps described thus far, heavily doped N-type regions (source and drain 1014 and 1015) and heavily doped P-type regions (source and drain 1017) are formed (FIG. 10(D)).

Figure 11A:
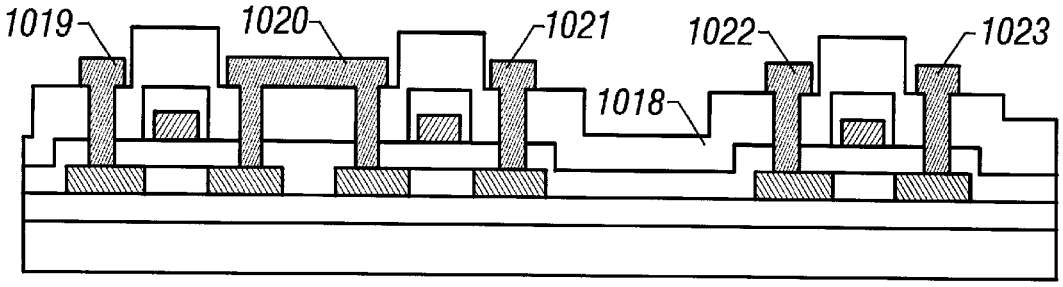
FIGS. 11(A) and 11(B) are cross-sectional views, illustrating following low-temperature polysilicon process steps.
Figure 11B:
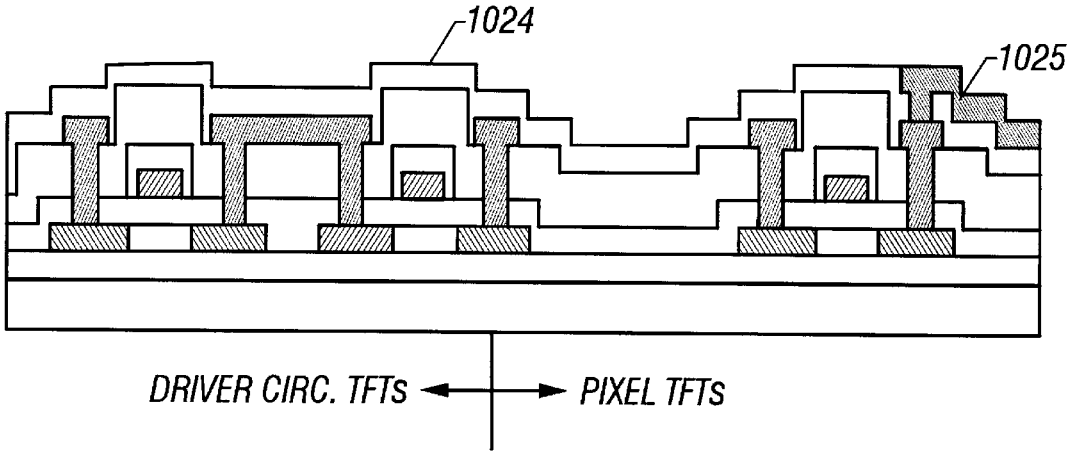
Figure 12A:
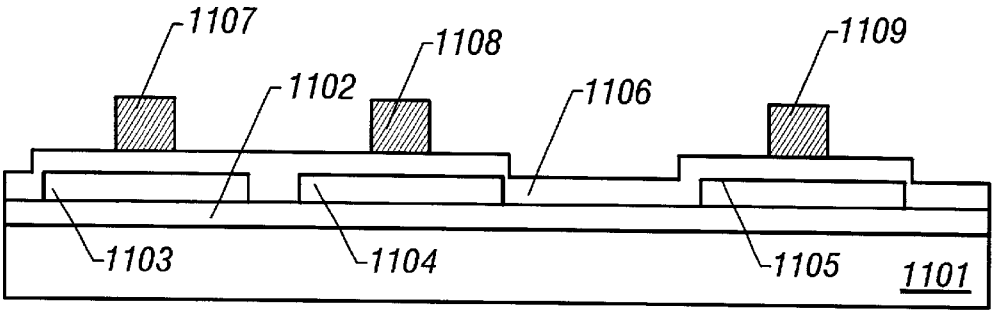
FIGS. 12(A)–12(D) are cross-sectional views, illustrating high-temperature polysilicon process steps carried out after the steps illustrated in FIGS. 11(A) and 11(B)
Figure 12B:
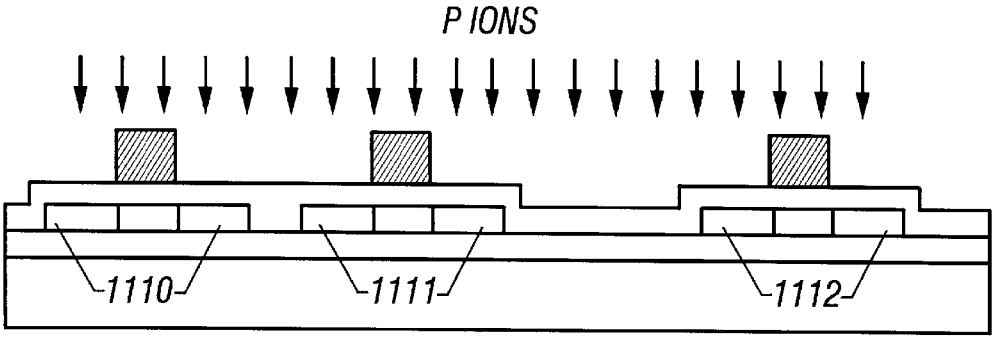
Figure 12C:
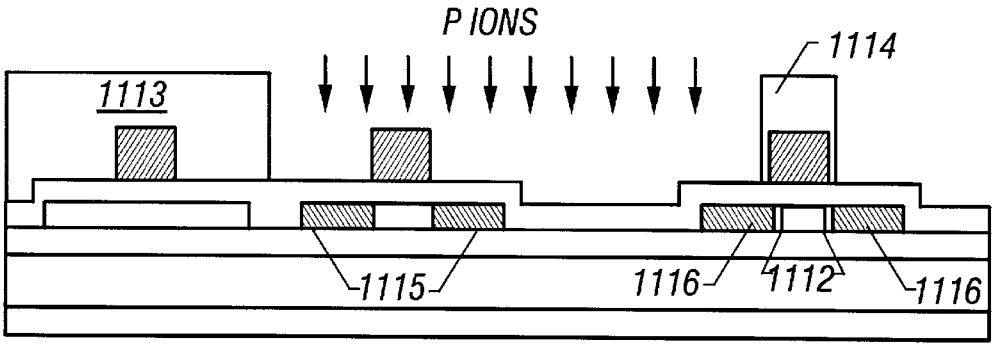
Figure 12D:
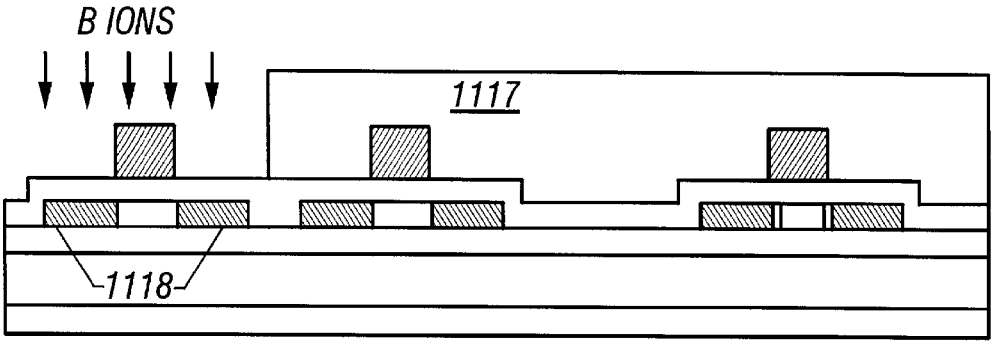

Then, the laminate is thermally annealed at 450–850° C. for 0.5 to 3 hours to repair the damage created by the doping. In this way, the dopants are activated. At the same time, the crystallinity of the silicon is recovered. Thereafter, as shown in FIG. 11(A), a silicon oxide film having a thickness of 3000 to 6000 Å is formed as an interlayer dielectric 1018 over the whole surface by plasma CVD. This may be a silicon nitride film or a multilayer film of silicon oxide layers and silicon nitride layers. The interlayer dielectric 1018 is etched by a wet etching process or a dry etching process to form contact holes in the source/drain regions.

Then, an aluminum film or a multilayer film of titanium and aluminum is formed to a thickness of 2000 to 6000 Å by sputtering techniques. This film is etched so as to create electrodes/interconnects, 1019, 1020, and 1021, for a peripheral circuit and pixels/interconnects, 1022 and 1023, for pixel TFTs (FIG. 11(A)).

Subsequently, a silicon nitride film 1024 is formed as a passivation film having a thickness of 1000 to 3000 Å by plasma CVD. This silicon nitride film is etched to create contact holes extending to the electrodes 1023 of the pixel TFTs. An ITO (indium-tin oxide) film having a thickness of 500 to 1500 Å is formed by sputtering. Finally, the ITO film is etched to form pixel electrodes 1025. In this manner, the peripheral driver circuit and active matrix circuit are formed integrally (FIG. 11(B)).

The process sequence of the present example is described by referring to FIGS. 12(A)–12(D), taking as an example a high-temperature process for fabricating silicon gate polysilicon TFTs.

The process sequence for fabricating the TFTs forming the peripheral logic circuit is shown on the left sides of FIGS. 12(A)–12(D). The process sequence for fabricating the active matrix circuit is shown on the right sides. First, a silicon oxide film is formed as a buffer oxide film 1102 on a quartz substrate 1101 to a thickness of 1000 to 3000 Å. This silicon oxide film may be formed in an oxygen ambient by sputtering or plasma CVD.

Then, an amorphous or polycrystalline silicon film is formed to a thickness of 300 to 1500 Å, preferably 500 to 1000 Å, by plasma CVD or LPCVD. The silicon film is thermally annealed at a temperature higher than 500° C., preferably 800–950° C., to crystallize the silicon film or to enhance the crystallinity. After the crystallization, the crystallinity may be further enhanced by carrying out photoannealing. Furthermore, during the crystallization making use of thermal annealing, an element (or, a catalytic element) such as nickel for promoting crystallization of silicon may be added, as described in Japanese Patent Laid-Open Nos. 244103/1994 and 244104/1994.

Then, the silicon film is etched to form islands of an active layer 1103 for P-channel TFTs forming a driver circuit, islands of an active layer 1104 for N-channel TFTs, and islands of an active layer 1105 for pixel TFTs forming a matrix circuit. Furthermore, a gate-insulating film 1106 of silicon oxide is formed to a thickness of 500 to 2000 Å by sputtering in an oxygen ambient. The gate-insulating film may be formed by plasma CVD. Where the silicon oxide film is formed by plasma CVD, it is desired to use nitrogen monoxide ($N_2O$) as a gaseous raw material. Alternatively, oxygen ($O_2$) and monosilane ($SiH_4$) may be employed.

Subsequently, a polycrystalline silicon film having a thickness of 2000 Å to 5 $\mu$m, preferably 2000 to 6000 Å, is formed by LPCVD over the whole surface of the laminate. To enhance the electrical conductivity, a trace amount of phosphorus is added to the polycrystalline silicon film. This polysilicon film is etched to form gate electrodes 1107, 1108, and 1109 (FIG. 12(A)).

Then, phosphorus ions are introduced into all the islands of the active layers by self-aligned ion implantation techniques, using phosphine ($PH_3$) as a dopant gas. At this time, the gate electrodes are used as a mask. The dose is $1\times10^{12}$ to $5\times10_{13}$ atoms/cm$^2$. As a result, lightly doped N-type regions 1110, 1111, and 1112 are formed (FIG. 12(B)).

Thereafter, a photoresist mask 1113 for covering the active layer for the P-channel TFTs is formed. Another photoresist mask 1114 for covering the active layer for the pixel TFTs up to the portions which are spaced 3 $\mu$m from the ends of the gate electrodes is formed. Phosphorus ions are introduced again by ion doping, using phosphine ($PH_3$) as a dopant gas. The dose is $1\times10^{12}$ to $5\times10_{13}$ atoms/cm$^2$. As a result, heavily doped N-type regions, or source and drain, 1115 and 1116, are formed. Those regions of the lightly doped N-type regions of the active layer for the pixel TFTs which are capped with the mask are not implanted with phosphorus ions at this time and so these regions remain lightly doped N-type (FIG. 12(C)).

Then, a photoresist mask 1117 for covering the active layer for the N-channel TFTs is formed. Boron ions are introduced again by ion doping, using diborane ($B_2H_6$) as a dopant gas. The dose is $5\times10^{14}$ to $8\times10^{15}$ atoms/cm$^2$. Consequently, the dose of boron is in excess of the dose of phosphorus. The previously formed, lightly doped N-type regions turn into heavily doped P-type regions 1118. As a result of these doping steps, heavily doped regions (source and drain, 1115 and 1116), heavily doped P-type regions (source and drain, 1118), and the lightly doped N-type region 1112 are formed (FIG. 12(D)).

Figure 13A:
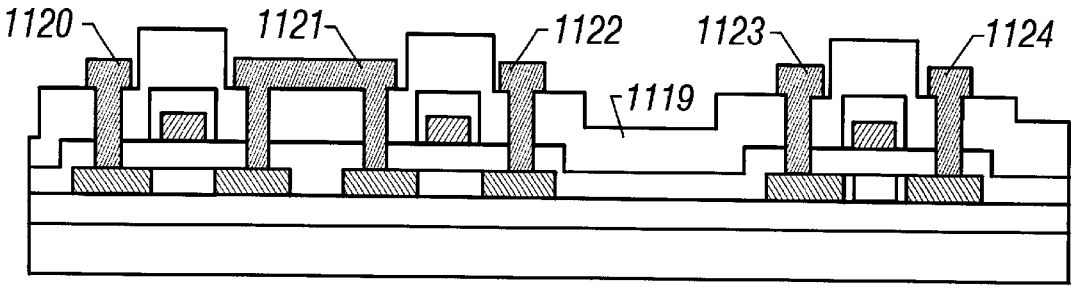
FIGS. 13(A) and 13(B) are cross-sectional views, illustrating following high-temperature polysilicon process steps.

Then, the laminate is thermally annealed at 450–850° C. for 0.5 to 3 hours to repair the damage created by the doping. In this way, the dopants are activated. At the same time, the crystallinity of the silicon is recovered. Thereafter, as shown in FIG. 13(A), a silicon oxide film having a thickness of 3000 to 6000 Å is formed as an interlayer dielectric 1119 over the whole surface by plasma CVD. This may be a silicon nitride film or a multilayer film of silicon oxide layers and silicon nitride layers. The interlayer dielectric 1119 is etched by a wet etching process or a dry etching process to form contact holes in the source/drain regions. Then, an aluminum film or a multilayer film of titanium and aluminum is formed to a thickness of 2000 to 6000 Å by sputtering. This film is etched so as to create electrodes/interconnects, 1120, 1121, and 1122, for a peripheral circuit and electrodes/interconnects, 1123 and 1124, for pixel TFTs (FIG. 13(A)).

Figure 13B:
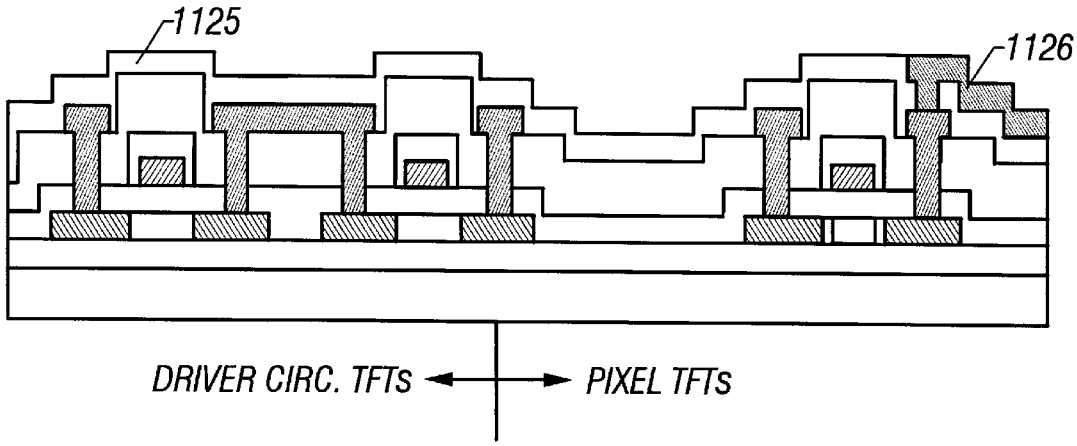

Subsequently, a silicon nitride film 1125 is formed as a passivation film having a thickness of 1000 to 3000 Å by plasma CVD. This silicon nitride film is etched to create contact holes extending to the electrodes 1124 of the pixel TFTs. An ITO (indium-tin oxide) film having a thickness of 500 to 1500 Å is formed by sputtering. Finally, the ITO film is etched to form pixel electrodes 1126. In this manner, the peripheral driver circuit and active matrix circuit are formed integrally (FIG. 13(B)).

In the examples described thus far, the driver circuit and the pixel matrix circuit can be formed integrally. Therefore, if two separate signal line driver circuits for activating two sets of signal lines, respectively, which are assigned to upper and lower halves, respectively, of the frame of image displayed on the viewing screen are provided, a large area is not needed. Hence, a liquid crystal display of reduced size can be accomplished. Furthermore, since the signal lines are vertically divided into two groups, the load capacitance and load resistance of the signal lines are halved. As a consequence, the display device can be driven with small driving capability and in a short time. The driver circuits can be built with a point-at-a-time scanning system. This dispenses with analog buffer and large sample-and-hold capacitors which would be normally necessitated where the line-at-a-time scanning drive method is adopted. Consequently, the area occupied by the driver circuits themselves can be reduced. This is a further advantage to miniaturization.

In the above example, the driver circuits are of the monolithic construction. The invention can also be applied to a display device comprising an active matrix circuit consisting of amorphous TFTs, together with outside driver circuits attached to the outside of glass substrates.

As described thus far, in the present invention, signal lines are divided into two sets corresponding to the upper and lower halves of the frame of image displayed. The two sets of signal lines are driven by two signal line driver circuits, respectively. When one of the two driver circuits is operating, operation of the other is stopped. As a consequence, a great reduction in the electric power consumed can be accomplished.

What is claimed is:

1. An active matrix display comprising:

a first pixel region having first pixels in a matrix form;

first signal lines for supplying image signals to said first pixels;

a first signal line drive circuit for driving said first signal lines;

a second pixel region having second pixels in a matrix form;

second signal lines for supplying image signals to said second pixels;

a second signal line drive circuit for driving said second signal lines;

scanning signal lines for supplying scanning signals to said first and second pixels;

a scanning line driver circuit for driving said scanning signal lines;

control means for controlling a supply of clock pulses for said first and second signal line drive circuits, wherein said control means halts the supply of said clock pulses for said first signal line drive circuit during the scanning of said second signal line drive circuit, and wherein said control means halts the supply of said clock pulses for said second signal line drive circuit during the scanning of said first signal line drive circuit; and switching means for switching operation between said first and second signal line drive circuits alternately, wherein said control means comprises:

a frequency division circuit for dividing first clock pulses to said scanning line driver circuit;

a first AND gate responsive to an output from the frequency division circuit and to second clock pulses to generate the supply of clock pulses into said first signal drive circuit; and a second AND gate responsive to an inverted output from the frequency division circuit and the second clock pulses to generate the supply of clock pulses into said second signal drive circuit.

2. The display of claim 1, wherein said active matrix display device is a liquid crystal device.

3. An active matrix display comprising:

a first pixel region having first pixels in a matrix form; first, signal lines for supplying image signals to said first pixels; a first signal line drive circuit for driving said first signal lines;

a second pixel region having second pixels in a matrix form;

second signal lines for supplying image signals to said second pixels;

a second signal line drive circuit for driving said second signal lines;

scanning signal lines for supplying scanning signals to said first and second pixels;

a scanning line driver circuit for driving said scanning signal lines; and switching means for switching operation between said first, and second signal line drive circuit alternately;

control means for controlling power supply for said first and second signal line drive circuits, wherein said control means halts the power supply for said first signal line drive circuit during the scanning of said second signal line drive circuit, and wherein said control means halts the power supply for said second signal line drive circuit during the scanning of said first signal line drive circuit, said control means comprising:

a frequency division circuit for driving first clock pulses to be applied to said scanning line driver circuit;

a first switching circuit for controlling power supply for said first signal line drive circuit in response to an output of said frequency division circuit; and a second switching circuit for controlling power supply for said second signal drive circuit in response to the output of said frequency division circuit, said second switching circuit being distinct from said first switching circuit;

wherein said first switching circuit is in an ON state when said second switching circuit, is an OFF state, and said first switching circuit is in an OFF state when said second switching circuit is in an ON state.

4. An active matrix display device according to claim 3, wherein said device is a liquid crystal device.

5. An active matrix display device comprising:

a substrate;

a plurality of pixel electrodes formed over said substrate;

a plurality of switching elements formed over said substrate for switching said pixel electrodes, wherein each of said switching elements comprises at least one thin film transistor;

at least first and second signal line driver circuits for driving said plurality of switching elements;

a scanning driver circuit for scanning said plurality of switching elements;

a frequency division circuit for dividing first clock pulses to be applied to said scanning line driver circuit;

a first AND gate responsive to an output of said frequency division circuit and to second clock pulses for supplying clock pulses to said first signal driver circuit;

a second AND gate responsive to an inverted output of said frequency division circuit and to the second clock pulses for supplying clock pulses to said second signal driver circuit.

6. An active matrix display device according to claim 5, wherein said device is a liquid crystal device.

7. An active matrix display device according to claim 5, wherein each of said first and second signal line driver circuits comprises thin film transistors formed over said substrate.

8. An active matrix display device comprising:

a substrate;

a plurality of pixel electrodes formed over said substrate;

a plurality of switching elements formed over said substrate for switching said pixel electrodes, wherein each of said switching elements comprises at least one thin film transistor;

at least first and second signal line driver circuits for driving said plurality of switching elements;

a scanning driver circuit for scanning said plurality of switching elements;

a frequency division circuit for dividing first clock pulses to be applied to said scanning line driver circuit;

a first switching circuit for controlling power supply for said first signal line driver circuit in response to an output of said frequency division circuit; and a second switching circuit for controlling power supply for said second signal driver circuit in response to the output of said frequency division circuit wherein said first switching. circuit is distinct from said second switching circuit, wherein said first switching circuit is in an ON state when said second switching circuit is an OFF state, and said first switching circuit is in an OFF state when said second switching circuit is in an ON state.

9. An active matrix display device according to claim 8 wherein said device is a liquid crystal device.

10. An active matrix display device according to claim 8 wherein each of said first and second signal line driver circuits comprises thin film transistors formed over said substrate.

11. An active matrix display comprising:

a first pixel region having first pixels in a matrix form;

first signal lines for supplying image signals to said first pixels;

a first signal line drive circuit for driving said first signal lines;

a second pixel region having second pixels in a matrix form;

second signal lines for supplying image signals to said second pixels;

a second signal line drive circuit for driving said second signal lines;

scanning signal lines for supplying scanning signals to said first and second pixels;

a scanning line driver circuit for driving said scanning signal lines;

control means for controlling a supply of clock pulses for said first and second signal line drive circuits, wherein said control means halts the supply of said clock pulses for said first signal line drive circuit during the scanning of said second signal line drive circuit, and wherein said control means halts the supply of said clock pulses for said second signal line drive circuit during the scanning of said first signal line drive circuit; and switching means for switching operation between said first and second signal line drive circuits, wherein said control means comprises:

means for generating a first pulse and a second pulse, wherein each level of the first and second pulses during a period of supplying scanning signals to said first pixels is different from that during a period of supplying scanning signals to said second pixels;

a first AND gate responsive to said first pulse and to second clock pulses to generate the supply of clock pulses into said first signal drive circuit; and a second AND gate responsive to said second pulse and to the second clock pulses to generate the supply of clock pulses into said second signal drive circuit.

12. An active matrix display device according to claim 11, wherein said first pulse is an output of a frequency division circuit and said second pulse is an inverted output of said frequency division circuit.

13. An active matrix display comprising:

a first pixel region having first pixels in a matrix form;

first signal lines for supplying image signals to said first pixels;

a first signal line drive circuit for driving said first signal lines;

a second pixel region having second pixels in a matrix form;

second signal lines for supplying image signals to said second pixels;

a second signal line drive circuit for driving said second signal lines;

scanning signal lines for supplying scanning signals to said first and second pixels;

a scanning line driver circuit for driving said scanning signal lines; and switching means for switching operation between said first and second signal line drive circuit alternately;

control means for controlling power supply for said first and second signal line drive circuits, wherein said control means halts the power supply for said first signal line drive circuit during the scanning of said second signal line drive circuit, and wherein said control means halts the power supply for said second signal line drive circuit during the scanning of said first signal line drive circuit, said control means comprising:

means for generating a first pulse and a second pulse wherein each level of the first and second pulses during a period of supplying scanning signals to said first pixels is different from that during a period of supplying scanning signals to said second pixels;

a first switching circuit for controlling power supply for said first signal line drive circuit in response to said first pulse; and a second switching circuit for controlling power supply for said second signal drive circuit in response to said second pulse wherein said second switching circuit is distinct from said first switching circuit;

wherein said first switching circuit is in an ON state when said second switching circuit is an OFF state, and said first switching circuit is in an OFF state when said second switching circuit is in an ON state.

14. An active matrix display device according to claim 13, wherein said first pulse is an output of a frequency division circuit and said second pulse is an inverted output of said frequency division circuit.

15. An active matrix display device comprising:

a substrate;

a plurality of first pixel electrodes formed over said substrate;

a plurality of second pixel electrodes formed over said substrate;

a plurality of first switching elements formed over said substrate for switching said second pixel electrodes, wherein each of said switching elements comprises at least one thin film transistor;

a plurality of second switching elements formed over said substrate for switching said second pixel electrodes, wherein each of said second switching elements comprises at least one thin film transistor;

at least first and second signal line driver circuits for driving said plurality of switching elements wherein said first signal line driver circuit exclusively drives said first switching elements and said second signal line driver circuit exclusively drives said second switching elements;

a scanning driver circuit for scanning said plurality of first and second switching elements;

means for generating a first pulse and a second pulse having an opposite polarity to said first pulse;

a first AND gate responsive to said first pulse and to second clock pulses for generating clock pulses to said first signal driver circuit; and a second AND gate responsive to said second pulse and to the second clock pulse for generating clock pulses to said second signal driver circuit.

16. An active matrix display device comprising:

a substrate;

a plurality of pixel electrodes formed over said substrate;

a plurality of switching elements formed over said substrate for switching said pixel electrodes, wherein each of said switching elements comprises at least one thin film transistor;

at least first and second signal line driver circuits for driving said plurality of switching elements;

a scanning driver circuit for scanning said plurality of switching elements;

means for generating a first pulse and a second pulse having an opposite polarity to said first pulse;

a first switching circuit for controlling power supply for said first signal line driver circuit in response to said first pulse; and a second switching circuit for controlling power supply for said second signal driver circuit in response to said second pulse wherein said second switching circuit is distinct from said first switching circuit, wherein said first switching circuit is in an ON state when said second switching circuit is an OFF state, and said first switching circuit is in an OFF state when said second switching circuit is in an ON state.

* * * * *

UNITED STATES PATENT AND TRADEMARK OFFICE

CERTIFICATE OF CORRECTION

PATENT NO. : 6,246,399 B1 
DATED : June 12, 2001
INVENTOR(S) : Yasukuni Yamane, Hidehiko Chimura and Jun Koyama It is certified that error appears in the above-identified patent and that said Letters Patent is hereby corrected as shown below:

Title page,
Item [73], Assignee: after "Semiconductor Energy Laboratory Co., Ltd., Kanagawa (JP)", please add -- Sharp Kabushiki Kaisha, Osaka (JP) --.

Signed and Sealed this

Tenth Day of December, 2002

JAMES E. ROGAN
*Director of the United States Patent and Trademark Office*